United States Patent [19]

Ishii

[11] Patent Number: 4,923,409

[45] Date of Patent: May 8, 1990

[54] LOCKING DEVICE FOR CONNECTORS

[75] Inventor: Takashi Ishii, Shizuoka, Japan

[73] Assignee: Yazaki Corporation, Tokyo, Japan

[21] Appl. No.: 301,333

[22] Filed: Jan. 25, 1989

[30] Foreign Application Priority Data

Feb. 12, 1988 [JP] Japan ..... 63-16350[U]

[51] Int. Cl.[5] ..... H01R 13/639

[52] U.S. Cl. ..... 439/358; 439/350; 439/357

[58] Field of Search ..... 439/350, 353–355, 439/357, 358, 352

[56] References Cited

U.S. PATENT DOCUMENTS

| | | | |
|---|---|---|---|
| 3,417,365 | 12/1968 | Krehbiel | 339/91 R |
| 3,824,523 | 7/1974 | McGhee | 439/350 X |
| 4,449,776 | 5/1984 | Carmo et al. | 439/350 |
| 4,462,654 | 7/1984 | Aiello | 339/91 R |
| 4,789,343 | 12/1988 | Dougherty et al. | 439/358 X |

FOREIGN PATENT DOCUMENTS 8633615 3/1987 Fed. Rep. of Germany .

*Primary Examiner*—Steven C. Bishop

*Attorney, Agent, or Firm*—Venable, Baetjer and Howard

[57] ABSTRACT

A locking device for connector adapted to be locked by fitting projections formed on both sides of a male connector housing in engaging holes formed in locking arms connected to the side walls of a female connector housing, characterized in that each of the side walls of said female connector housing comprises a riser portion, and a raised supporting portion and a lower non-supporting portion which are integrally connected, respectively, to both sides of the riser portion, and each of said locking arms comprises a connecting riser portion, and an unlocking lever and a locking plate portion which are integrally connected, respectively, through the connecting riser portion to both sides thereof, said unlocking lever extending above and away from said supporting portion, said locking plate portion extending above and away from said non-supporting portion, said locking plate portion comprising an unlocking force transmitting portion integrally connected thereto as an extension of the unlocking lever. This locking device is further characterized in that the connecting riser has a cutaway portion formed therein.

2 Claims, 5 Drawing Sheets

LOCKING DEVICE FOR CONNECTORS

BACKGROUND OF THE INVENTION

1. Field of the Invention

This invention relates to a locking device for an electric connector for use in connection of wiring harness, etc.

2. Description of the Prior Art

Connection of an electric connector is made by engaging and connecting a male connector housing having a plurality of terminal accommodating chambers, which are formed therein and in each of which a metal terminal fitting having an electric wire connected previously therewith is housed, with a female connector housing having also a plurality of terminal accommodating chambers which are formed therein and in each of which a metal terminal fitting having an electric wire connected previously therewith is housed, and then locking them. Since it is substantially necessary to unlock this locking device easily, a great many locking devices for electric connectors have so far been developed.

For example, a female connector housing which is integrally molded of a synthetic resin has locking arms formed on the side walls thereof, and a male connector housing which is molded of the same synthetic resin has projections formed integrally on the side walls thereof and adapted to engage with the locking arms, respectively. Each of the locking arms has a connecting riser portion which connects a locking plate portion having an engaging hole formed therein with an unlocking lever in such a manner that the outer surface of the former is aligned with the inner surface of the latter. In other words, each of the locking arms has a substantially crank-shaped configuration. The connecting riser portion is formed integrally and continuously with the supporting portion of the female connector housing. In the construction of each of the locking arms, the space between the locking plate portion and the female connector housing is kept small to make the entire locking device as compact as possible, whilst the space between the unlocking lever and the female connector housing is kept large to enable the unlocking lever to make a sufficient displacement so as not to interfere with the unlocking operation. Since the connecting riser portion is formed integrally and continuously with the supporting portion as mentioned above, the locking arms formed on the side walls of the female connector housing are allowed to assume a predetermined posture. However, this arrangement was disadvantageous in that, upon making unlocking operation, since the pushing force, that is; the unlocking force applied at a point on the unlocking lever is relaxed or reduced at the supporting portion and then transmitted to a point of application on the locking plate portion, it is required to apply a large pushing force to achieve the unlocking operation.

SUMMARY OF THE INVENTION

The present invention has been contemplated in view of the above-mentioned circumstances, and has for its object to provide a locking device for a connector which is additionally provided with means for making up for the relaxation or reduction in the unlocking force that occurs in the connecting portion between the connecting riser portion and the supporting portion of the female connector housing, thereby reducing the magnitude of the pushing force required for unlocking operation.

To achieve the above-mentioned object, according to the present invention, there is provided a locking device for a connector adapted to be locked by fitting projections formed on both sides of a male connector housing in engaging holes formed in locking arms connected to the side walls of a female connector housing, wherein each of the side walls of said female connector housing comprises a riser portion, and a raised supporting portion and a lower non-supporting portion which are integrally connected, respectively, to both sides of the riser portion, and each of said locking lever comprises a connecting riser portion, and an unlocking lever and a locking plate portion which are integrally connected, respectively, through the connecting riser portion to both sides thereof, said unlocking lever extending above and away from said supporting portion, said locking plate portion extending above and away from said non-supporting portion, said locking plate portion having said engaging hole formed therein and also comprising an unlocking force transmitting portion integrally connected as an extension of said unlocking lever extending beyond said connecting riser portion.

Further, said connecting riser portion has a cutaway portion formed therein to facilitate the deformation thereof thereby achieving a reduction in the magnitude of the force required for unlocking operation.

DESCRIPTION OF THE PREFERRED EMBODIMENTS

Figure 1:
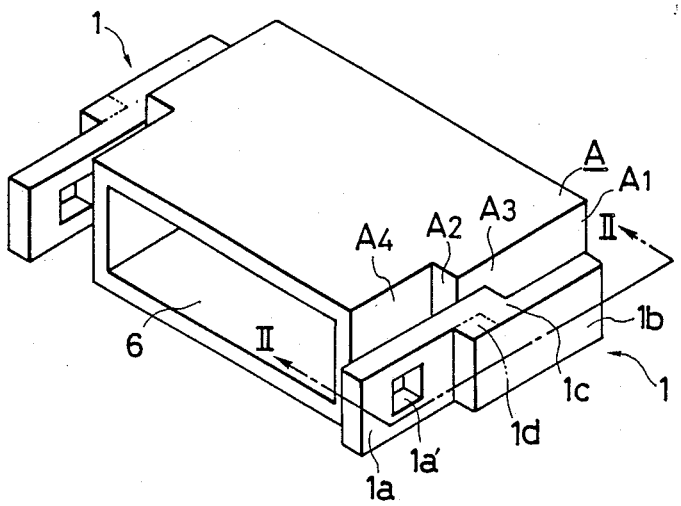
FIG. 1 is a perspective view of one embodiment of locking device for an electric connector according to the present invention.

FIG. 1 shows a perspective view of a female connector housing A which is molded integrally of a synthetic resin. This female connector housing A comprises an opening 6 in which a male connector housing (not shown) is inserted, and a side wall $A_1$ having a riser portion $A_2$. A locking arm 1 is connected to the side wall $A_1$. The side wall $A_1$ comprises a raised supporting portion $A_3$ and a lower non-supporting portion $A_4$ formed through the intermediary of the riser portion $A_2$.

The locking arm 1 is of a substantially Z-shaped section and is made up of a locking plate portion 1*a*, a connecting riser portion 1*c* connected thereto, and an unlocking lever 1*b* connected to the connecting riser portion 1c. The above-mentioned connecting riser portion 1c is connected to a part of the raised supporting portion A3 of the above-mentioned side wall $A_1$. The locking plate portion 1a is spaced away from the non-supporting portion $A_4$ by the height of the riser portion $A_2$. Further, the unlocking lever 1b is spaced away from the supporting portion $A_3$ of the side wall $A_1$. The above-mentioned locking plate portion 1a has an engaging hole 1a' formed therein. When projections of the above-mentioned male connector housing are fitted into the engaging holes 1a'', respectively, the male and female connector housings are locked each other.

Figure 2:
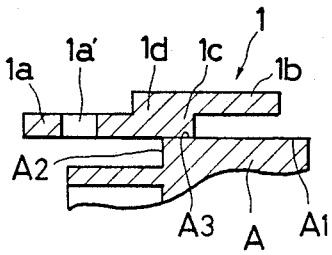
FIG. 2 is a sectional view of the locking device taken along line II—II in FIG. 1.

FIG. 2 is a sectional view showing the positional relationship between the locking arm 1 and the female connector housing A. Connected to the above-mentioned unlocking lever 1b is an unlocking force transmitting portion 1d (shown by imaginary line in FIG. 1) which extends beyond the connecting riser portion 1c onto the locking plate portion 1a and is formed as an integral unit thereof.

Since the locking device is constructed as mentioned above, upon unlocking the locking arms, when the unlocking lever 1b is depressed, the unlocking force is transmitted through the unlocking force transmitting portion 1d to the locking plate portion 1a. If the unlocking force transmitting portion 1d is not provided, then the above-mentioned unlocking force is relaxed or reduced at the supporting portion $A_3$ and so only a small proportion of the force actually applied is transmitted to the locking plate portion 1a. Stating in brief, provision of the unlocking force transmitting portion 1d makes it possible to compensate for the relaxation of the unlocking force at the supporting portion $A_3$ thereby reducing the magnitude of the force required for unlocking.

Figure 3:
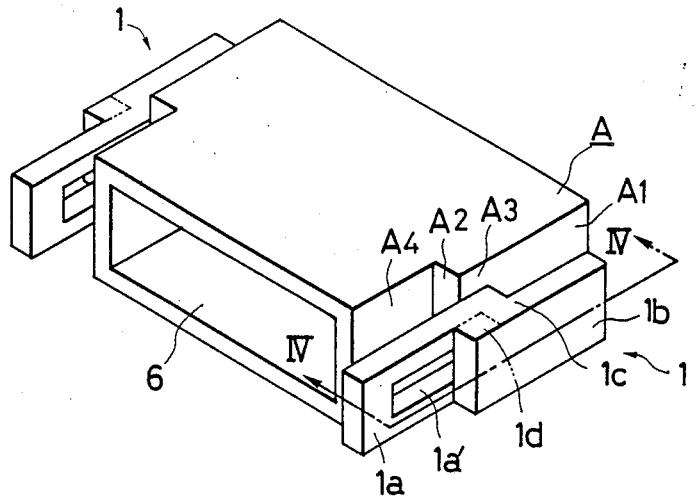
FIG. 3 is a perspective view of another embodiment of the present invention.
Figure 4:
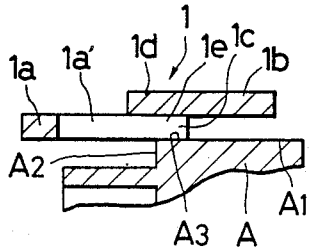
FIG. 4 is a sectional view of the another embodiment taken along line IV—IV in FIG. 3.
Figure 5:
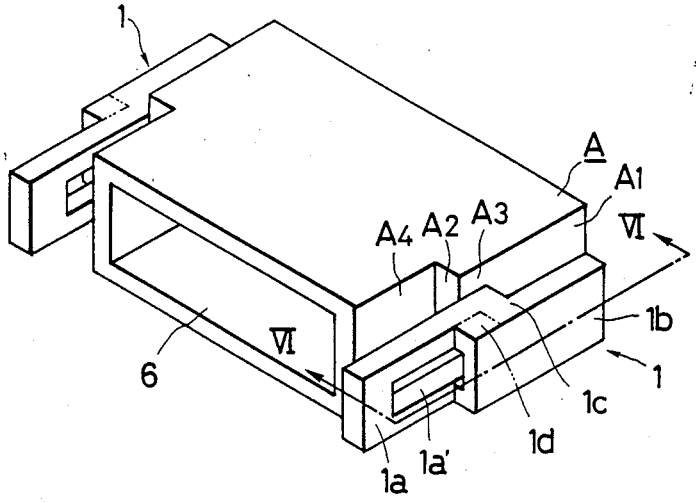
FIG. 5 is a perspective view of a further embodiment of the present invention.
Figure 6:
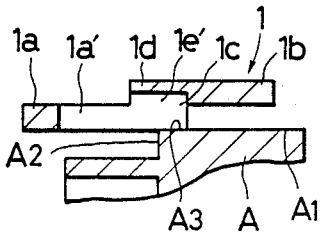
FIG. 6 is a sectional view of the further embodiment taken along line IV—IV in FIG. 5.
Figure 7:
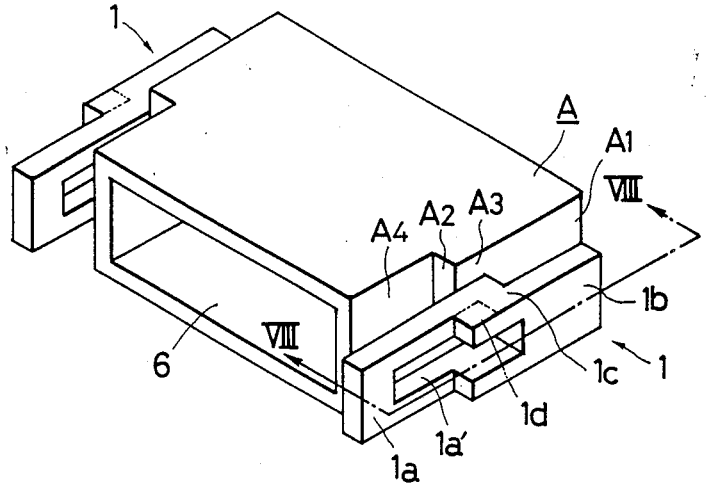
FIG. 7 is a perspective view of a still further embodiment of the present invention.
Figure 8:
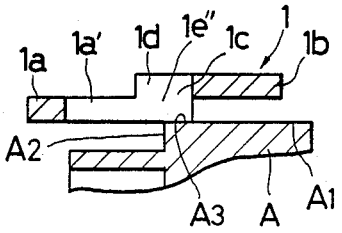
FIG. 8 is a sectional view taken along line VIII—VIII in FIG. 7.

FIGS. 3, 5 and 7 show alternative embodiments of locking device for an electric connector according to the present invention. Further, FIGS. 4, 6 and 8 are sectional views, respectively, showing the positional relationship between the locking arm 1 and the female connector A in these alternative embodiments. The locking arms 1 in these embodiments have cutaway portions 1e, 1e' and 1e'', respectively, formed therein and which follow the engaging holes 1a' and extends at least up to the position corresponding to the terminal end of the supporting portion $A_3$ of the connecting riser portion 1c. By this arrangement, at the time of unlocking operation, the connecting riser portion 1c can be deformed easily so that the unlocking force can be reduced further.

Figure 9:
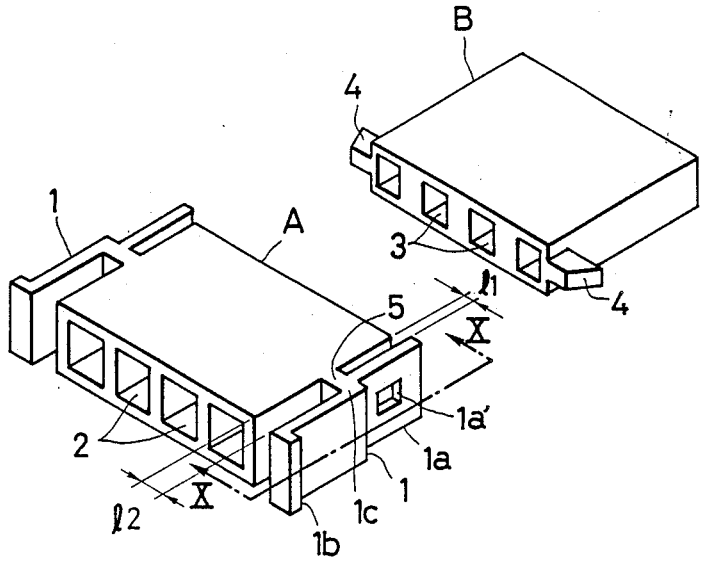
FIG. 9 PRIOR ART
FIG. 9 is a perspective view of a locking device for a prior art electric connector.
Figure 10:
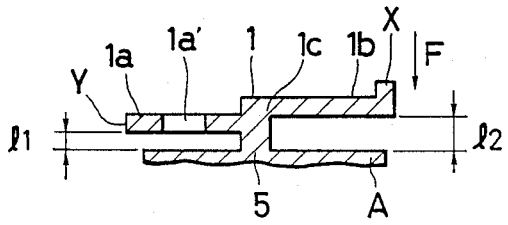
FIG. 10 PRIOR ART
FIG. 10 is a sectional view of the same taken along line X—X in FIG. 9.

In FIG. 9, reference character "A" denotes a female connector housing having a plurality of terminal accommodating chambers 2 formed therein, and "B" a male connector housing having a plurality of terminal accommodating chambers 3 therein. The female connector housing A and the male connector housing B are used with their chambers 2 and 3 accommodating metal terminal fittings with each of which an electric wire has previously been connected.

The female connector housing A which is integrally molded of a synthetic resin has locking arms 1 formed on the side wall thereof. The male connector housing B which is molded of the same synthetic resin has projections 4 formed integrally on the side walls thereof and adapted to engage with the locking arms 1, respectively. Each of the locking arms 1 has a connecting riser portion 1c which connects a locking plate portion 1a having an engaging hole 1a' formed therein with an unlocking lever 1b in such a manner that the outer surface of the former is aligned with the inner surface of the latter. In other words, the locking arm 1 has a substantially crank-shaped configuration. The connecting riser portion 1c is formed integrally and continuously with the supporting portion 5 of the female connector housing A. In the construction of each of the locking arms 1, the space $l_1$ between the locking plate portion 1a and the female connector housing A is kept small to make the entire locking device as compact as possible, whilst the space $l_2$ between the unlocking lever 1b and the female connector housing A is kept large to enable the unlocking lever 1b to make a sufficient displacement so as not interfere with the unlocking operation. Since the connecting riser portion 1c is formed integrally and continuously with the supporting portion 5 as mentioned above, the locking arms 1 formed on the side walls of the female connector housing A are allowed to assume a predetermined posture.

In the above-mentioned arrangement, the female and male connectors A and B are locked with each other when each of the projections 4 is engaged with the corresponding one of the holes 1a' in the locking plate portions 1a. The arrangement is made such that when the unlocking lever 1b of the locking arm 1 is pushed towards the connector housing A so as to displace the locking plate portion 1a away from the connector housing A through the intermediary of the connecting riser portion 1c thereby disengaging the holes 1a' from the respective projections 4, the female connector A can be unlocked from the male connector B. However, this arrangement was disadvantageous in that since the pushing force F applied at a point X on the unlocking lever 1b is relaxed or reduced at the supporting portion 5 and then transmitted to a point Y of application of the locking plate portion 1a, it is required to apply a large pushing force for unlocking operation.

What is claimed is:

1. A locking device for a connector adapted to be locked by fitting projections formed on both sides of a male connector housing in engaging holes 1a' formed in locking arms 1 connected to the side walls of a female connector housing, wherein each of the side walls $A_1$ of said female connector housing A comprises a riser portion $A_2$, and a raised supporting portion $A_3$ and a lower non-supporting portion $A_4$ which are integrally connected, respectively, to both sides of the riser portion, and each of said locking arms 1 comprises a connecting riser portion 1c, and an unlocking lever 1b and a locking plate portion 1a which are integrally connected, respectively, through the connecting riser portion 1c to both sides thereof, said unlocking lever 1b extending above and away from said supporting portion $A_3$, said locking plate portion 1a extending above and away from said non-supporting portion $A_4$, said connecting riser portion 1c having a surface that is generally coplanar with said unlocking plate portion 1a and in abutment with said raised supporting portion $A_3$, said locking plate portion 1a having said engaging hole 1a' formed therein and also comprising an unlocking force transmitting portion 1d integrally connected thereto as an extension of said unlocking lever 1b extending beyond said connecting riser portion 1c.

2. A locking device for a connector as claimed in claim 1, wherein said connecting riser portion 1c has a cutaway portion (1e, 1e', 1e'') formed therein.

* * * * *